US011541564B2

(12) United States Patent
Gulminelli

(10) Patent No.: US 11,541,564 B2
(45) Date of Patent: Jan. 3, 2023

(54) APPARATUS FOR CUTTING PIPES MADE OF PLASTIC MATERIAL

(71) Applicant: SICA S.p.A., Alfonsine (IT)

(72) Inventor: Marco Gulminelli, Ravenna (IT)

(73) Assignee: SICA S.p.A., Alfonsine (IT)

( * ) Notice: Subject to any disclaimer, the term of this patent is extended or adjusted under 35 U.S.C. 154(b) by 0 days.

(21) Appl. No.: 17/056,808

(22) PCT Filed: Jun. 18, 2019

(86) PCT No.: PCT/IB2019/055069
§ 371 (c)(1),
(2) Date: Nov. 19, 2020

(87) PCT Pub. No.: WO2019/244015
PCT Pub. Date: Dec. 26, 2019

(65) Prior Publication Data

US 2021/0122074 A1 Apr. 29, 2021

(30) Foreign Application Priority Data

Jun. 20, 2018 (IT) ..... 102018000006524

(51) Int. Cl.
*B26D 3/16* (2006.01)
*B26D 5/06* (2006.01)

(52) U.S. Cl.
CPC ..... *B26D 3/166* (2013.01); *B26D 5/06* (2013.01)

(58) Field of Classification Search
CPC .. B26D 3/16; B26D 3/166; B26D 5/06; B23B 27/08
See application file for complete search history.

(56) References Cited

U.S. PATENT DOCUMENTS 3,771,393 A * 11/1973 Gatto ..... B23D 47/10 408/124
4,084,463 A 4/1978 Kanbara et al.
(Continued)

FOREIGN PATENT DOCUMENTS

CN 201079965 Y * 7/2008
CN 201079965 Y 7/2008
(Continued)

OTHER PUBLICATIONS

International Search Report and Written Opinion dated Dec. 18, 2019 from counterpart International Patent Application No. PCT/IB2019/055069.
(Continued)

*Primary Examiner* — Phong H Nguyen
(74) *Attorney, Agent, or Firm* — Shuttleworth & Ingersoll, PLC; Timothy J. Klima

(57) ABSTRACT

An apparatus for cutting pipes made of plastic material in automatic cutter machines, including a tool for cutting pipes made of plastic material, a first rocker arm supporting the cutting tool, movable between a non-operating configuration at which the tool is disengaged from the pipe and an operating configuration wherein the tool is designed to exert its cutting action on the pipe, a second arm, for controlling the first arm, operatively connected to the first arm for moving it at least between its non-operating and operating configurations, the second arm comprising a first electric actuator and a supporting body slidably connected for modifying its reciprocal position between a close position and a spaced-apart position.

7 Claims, 10 Drawing Sheets

(56) References Cited

U.S. PATENT DOCUMENTS

| | | | | |
|---|---|---|---|---|
| 6,009,780 | A * | 1/2000 | Savioli | B23D 21/04 83/184 |
| 2011/0100638 | A1* | 5/2011 | Ramfjord | B23D 45/126 166/361 |
| 2019/0022773 | A1* | 1/2019 | Choi | B26D 7/265 |
| 2020/0114536 | A1* | 4/2020 | Tabanelli | B26D 7/10 |

FOREIGN PATENT DOCUMENTS

| | | | |
|---|---|---|---|
| CN | 201095136 | Y | 8/2008 |
| CN | 201115970 | Y | 9/2008 |
| CN | 102047015 | A | 5/2011 |
| CN | 106272621 | A | 1/2017 |
| CN | 206690173 | U | 12/2017 |
| EP | 0826467 | A1 | 3/1998 |
| GB | 1116961 | A | 6/1968 |

OTHER PUBLICATIONS

Chinese Office Action dated Nov. 18, 2021 from counterpart Chinese Patent Application No. 201980041443.6.

* cited by examiner

APPARATUS FOR CUTTING PIPES MADE OF PLASTIC MATERIAL

This application is the National Phase of International Application PCT/IB2019/055069 filed Jun. 18, 2019 which designated the U.S.

This application claims priority to Italian Patent Application No. 102018000006524 filed Jun. 20, 2018, which application is incorporated by reference herein.

TECHNICAL FIELD

This invention relates to an apparatus for cutting pipes made of plastic material.

In particular, the invention relates to an apparatus for cutting pipes made of plastic material in automatic cutter machines.

BACKGROUND ART

In the automatic cutting machines for pipes made of plastic material, which are normally positioned in line with the extruder which produces pipes in a continuous fashion, there is usually a cutting unit or apparatus equipped with one or more respective tools, which are typically able to also execute a rotary movement around the pipe.

According to preferred embodiments, during the cutting step the cutting apparatus moves longitudinally in a synchronised fashion with the feeding of the pipe, the cutting tool is also fed radially until making contact with the pipe to penetrated through its thickness, all whilst simultaneously rotating about the axis of the pipe for executing a circumferential cut.

Once a cut has been made, thus defining a respective piece of pipe, the cutting tool is moved away radially from the pipe whilst the cutting apparatus is, in sequence, moved longitudinally to a suitable starting position for making a new cut.

The tools commonly used for cutting pipes, also as a function of wall thicknesses and different plastic materials, have fixed blades, idle blades or also circular toothed blades rotating by means of suitable drive units.

Commonly, the movement devices of the cutting elements are actuated pneumatically or hydraulically.

Patent document U.S. Pat. No. 4,084,463A shows an automatic apparatus for cutting plastic pipes having transversal cross-sections which are non-circular and irregular, through the use of blades, operatively connected to mobile arms moved by hydraulic drive means.

In particular, the hydraulic drive requires a plant which is rather complex and costly, especially supported by a mobile and often rotary apparatus and normally comprising a control unit with on-off or proportional valves, one or more electric motors, a tank, an hydraulic pump which draws oil from the tank, pressurises it and, through specific valves, sends it to the actuators.

In operational terms, with the cutting machines currently in use, there is a problem connected with the adoption of the above-mentioned hydraulic drive of the cutting elements.

In effect, since for productive efficiency requirements the cutting elements, as mentioned, move longitudinally in a synchronised fashion with the pipe during cutting, penetrating inside the pipe, in the event of a power failure or an emergency stop of the cutting machine, the pipe pushed by the extruder would continue to feed longitudinally at least for a certain period of time whilst the cutting apparatus, since it no longer has the necessary energy would not be able to disengage radially from the pipe, so it would be drawn by it with the risk of seriously damaging both the tool and the cutting machine and in general creating possible faults to the entire extrusion system.

In construction terms, a solution has been provided to this problem by coupling to the hydraulic cylinder, which radially feeds the cutting means towards the pipe, elastic elements (typically compression springs) which are compressed by the same hydraulic cylinder when the cutting unit is pushed to penetrate the pipe being processed.

In the case of an electrical power failure, and therefore hydraulic, the cylinder is no longer able to compress the springs to which it is coupled and the latter are therefore free to release the relative accumulated elastic energy, withdrawing the cutting unit (and, therefore, the tool) disengaging it from the pipe.

A similar result may be achieved by further complicating the hydraulic system, by inserting in place of the springs a suitable hydraulic accumulation device which is loaded under normal operating conditions with the aim of introducing the accumulated and pressurised oil in the circuit and thereby inducing the moving away of the cutting tool from the pipe being processed even in the absence of electrical energy.

However, the above-mentioned solutions, even though they have been shown to be efficient, are not free of drawbacks, in particular with regard to their complexity which is in addition to that of a basic hydraulic system which is already very articulated.

In particular, for some materials and specific cutting processes it is convenient to be able to control the speed, force and trajectory of perforation of the tool; to do this, it is necessary to further complicate the hydraulic system by inserting specific hydraulic valves of the proportional type and process dedicated control algorithms. In addition to the intrinsic complexity of said systems, the performance cannot exceed certain levels of precision due to the inevitable response inertias which are typical of hydraulic systems and the variability of behaviour which said systems have as a function of the operating conditions, such as, for example, temperature.

DISCLOSURE OF THE INVENTION

The aim of the invention is therefore to overcome the drawbacks of the prior art by means of an apparatus for cutting pipes made of plastic material which is at the same time effective, precise, easy to control and with an operation which is extremely repeatable.

Another aim of the invention is to provide a cutting apparatus which is able to deactivate instantaneously if there is a power failure or if there are emergency conditions, so as not to damage the cutting tools and, in general, the cutting machine in which it is installed.

Yet another aim of the invention is to provide a cutting apparatus comprising a limited number of components and which is therefore inexpensive to make and simple to install, inspect and maintain.

These aims and others, which are more apparent in the description which follows, are achieved, in accordance with this invention, by an apparatus for cutting pipes made of plastic material comprising the technical features described in one or more of the appended claims.

BRIEF DESCRIPTION OF THE DRAWINGS

The technical features of the invention, with reference to the above aims, are clearly described in the claims below and its advantages are more apparent from the detailed description which follows, with reference to the accompanying drawings which illustrate a preferred, non-limiting embodiment of the invention by way of example and in which:

DETAILED DESCRIPTION OF PREFERRED EMBODIMENTS OF THE INVENTION

Figure 1:
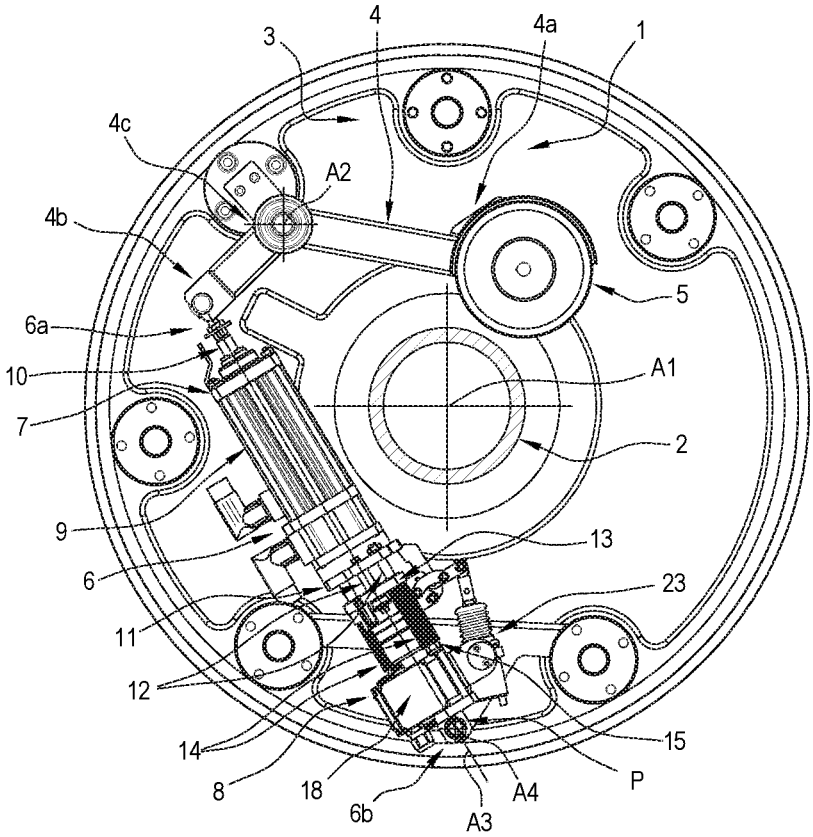
FIGS. 1 to 7 are front elevation views of a preferred embodiment of an apparatus for cutting pipes made of plastic material according to the invention, illustrating, respectively, different operating steps.

With reference to FIG. 1, the numeral 1 denotes in its entirety an apparatus for cutting pipes made of plastic material.

The cutting apparatus 1 is normally inserted inside a cutting machine located downstream of a continuous extrusion station designed to cut the pieces of pipe starting from a continuous pipe 2 coming from the extrusion station.

The pipe 2 made of plastic material, coming in a continuous fashion from the extrusion station, is cut into pieces of predetermined size.

The cutting apparatus 1 is supported by a rotatable structure 3 of the cutting machine.

The rotary structure 3 is designed to rotate, in known manner, about a respective central axis A1 of rotation substantially coinciding with the central axis of the pipe coming from the above-mentioned and not illustrated extrusion station and perpendicular to the plane of FIG. 1.

Advantageously, according to known methods not described here further, during the cutting step the cutting apparatus 1 is movable along the above-mentioned axis A1 in a synchronised fashion with the pipe 2 which moves forward, and then withdraws quickly to undertake a new cutting step.

The cutting apparatus 1 comprises a first rocker arm 4 supporting a tool 5 for cutting the pipe 2 made of plastic material.

The rotation of the rotatable structure 3 is such as to determine an engagement of the cutting tool 5 with the pipe 2 to be cut, along the entire circumference of the latter.

According to the preferred embodiment of the cutting apparatus 1 illustrated in the accompanying drawings, the cutting tool 5 is an idle circular blade.

Alternatively to the idle circular blade, it is possible to use, for example, according to variant embodiments not illustrated, fixed blades or rotary toothed blades for different types of plastic materials.

The cutting apparatus 1 comprises a second arm 6 for control of the above-mentioned first rocker arm 4 and a respective first electric actuator 7.

The first rocker arm 4 supports the above-mentioned cutting tool 5 positioned at a relative first end 4*a* and at a second end 4*b* it is pivoted on the second arm.

The first rocker arm 4 is pivoted, at a relative intermediate portion 4*c*, on the above-mentioned rotatable structure 3, so as to oscillate about a respective axis A2, parallel to the above-mentioned axis A1 of rotation of the rotatable structure 3.

The second control arm 6 extends longitudinally along a respective axis A3 and has two respective longitudinally opposite ends 6*a*, 6*b*, one upper and the other lower.

At its top end 6*a*, the second control arm 6, as mentioned, is pivoted on the first rocker arm 4.

At its lower end 6*b*, the second control arm 6 is in turn pivoted on the above-mentioned rotatable structure 3 by means of a pin P, so as to oscillate about a respective axis A4.

The second control arm 6 comprises the above-mentioned first electric actuator 7 of the linear type and a body 8 for supporting the first electric actuator 7.

The first linear electric actuator 7 advantageously has a cylinder 9 for housing electro-mechanical apparatuses and a rod 10 emerging from the cylinder 9 and designed to move longitudinally along the above-mentioned axis A3.

The rod 10 defines, with a relative upper end portion, the above-mentioned upper end 6*a* of the second control arm 6 pivoted on the first rocker arm 4.

Advantageously, according to a preferred embodiment, the first electric actuator 7 is of the type with a reduction gear unit integrated with epicyclic roller screw.

Alternative embodiments, not illustrated, comprise the use, as a first electric actuator 7 of electric-mechanical jacks of different types.

At a lower end portion of the cylinder 9 and integral with it there is a first plate 11 on which are fixed a plurality of rods 12 emerging away from the cylinder 9, in the direction of the above-mentioned longitudinal axis of extension A3 of the second control arm 6.

The supporting element 8 comprises a second plate 13, facing the above-mentioned first plate 11 and having respective through holes, in which the above-mentioned rods 12 emerging from the first plate 11 slidably engage.

As well as the above-mentioned second plate 13, respective helical springs 14 are fitted on some of the rods 12, advantageously made with an adequate length.

The springs 14 are advantageously mounted pre-compressed.

The two, first and second, plates 11, 13 are slidably movable between them by means of the above-mentioned rods 12.

The end turns of the helical springs 14, distal from the second plate 13, are engaged in abutment with respective stop elements 15, such as nuts and washers of known type.

As described in detail below, the first electric actuator 7 and the supporting body 8 are slidably connected for modifying their reciprocal position between a close-together position, illustrated for example in FIGS. 4 and 9, and a spaced-apart position, illustrated in FIGS. 1 and 8.

The springs 14 define, for the cutting apparatus 1, respective elastic means configured to push the first electric actuator 7 and the supporting body 8 to reach their close-together position.

Figure 8:
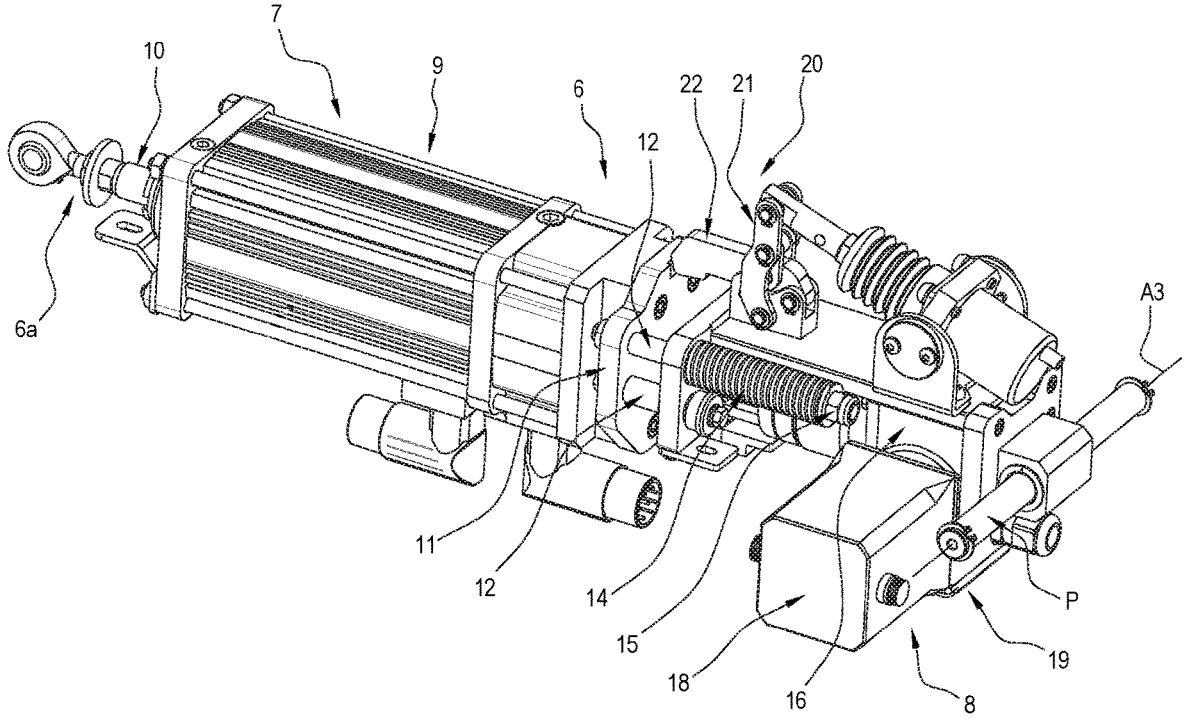
FIGS. 8 to 10 are schematic perspective views of a detail of the apparatus shown in the above-mentioned drawings, in different operating configurations.
Figure 9:
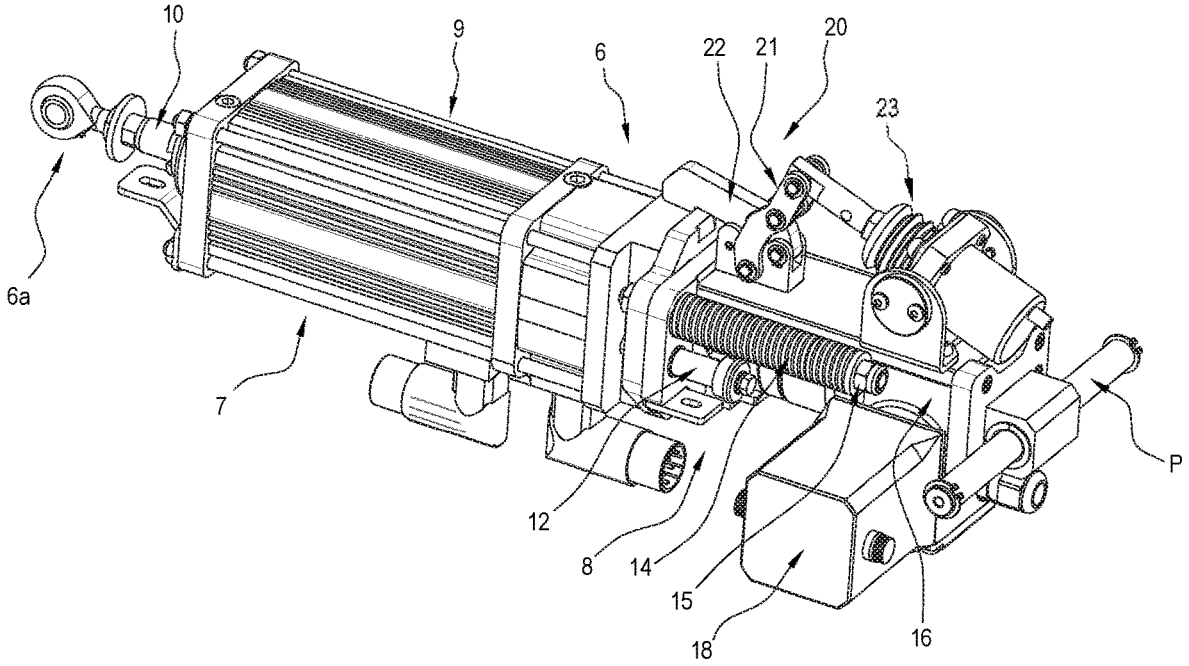

As illustrated in detail also in FIGS. 8 and 9, the supporting body 8 comprises a lead nut and screw mechanism 16 configured for moving along the axis A3 the assembly comprising the first actuator 7 and the first plate 11 relative to the second plate 13.

Figure 10:
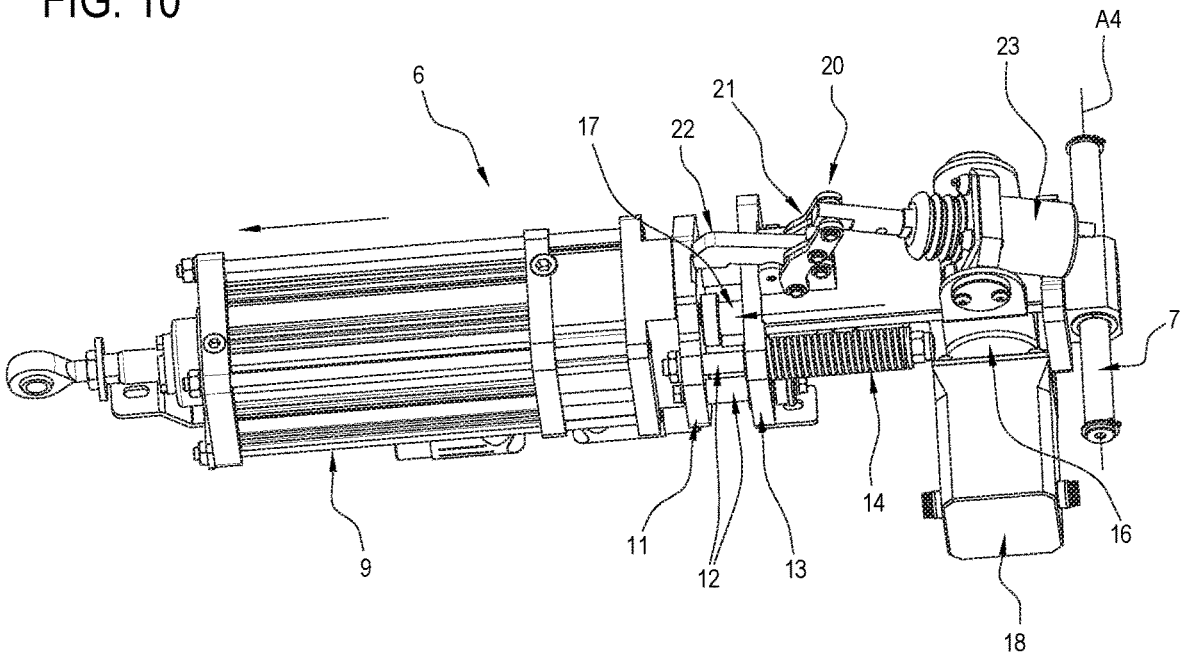

In other words, as illustrated in FIG. 10, the lead nut and screw mechanism 16 has a pushing rod 17, advantageously integrating the screw of the mechanism 16, designed to push the above-mentioned assembly away from the supporting body 8, to reach the above-mentioned spaced-apart position illustrated in FIG. 8.

The supporting body 8 also comprises a second electric actuator 18 designed to move the above-mentioned lead nut and screw mechanism 16.

The above-mentioned lead nut and screw mechanism 16 and the second electric actuator 18 define, in their entirety for the cutting apparatus 1, a drive element 19 to bring the first electric actuator 7 and the supporting body 8 to their mutually spaced-apart position.

As illustrated in detail in FIGS. 8 to 10, the cutting apparatus 1 comprises a locking element 20 for stably holding the first electric actuator 7 and the supporting body 8 in one between the above-mentioned close-together position and spaced-apart position.

According to the preferred embodiment of the cutting apparatus 1 illustrated in the accompanying drawings, the locking element 20 is configured for stably holding the first electric actuator 7 and the supporting body 8 in their mutual spaced-apart position, reached by means of the previous action of the element 19.

The locking element 20 advantageously has a knee-type linkage 21, which is able to prevent spontaneous release of the device, a release which may therefore be performed by a command.

The knee-type linkage 21 comprises a stop lever 22 designed to engage in contact with the first plate 11 to prevent it from moving towards the second plate 13.

The cutting apparatus 1 also comprises a third electric actuator 23 designed to control the movement of the linkage 21.

The third actuator 23 defines, for the cutting apparatus 1, respective disengagement means configured for freeing the locking element 20 and allowing the first electric actuator 7 and to the supporting body 8 to reaching their close-together position.

Advantageously, according to the preferred embodiment illustrated, the third electric actuator 23 is a linear actuator.

In use, as illustrated in FIG. 1, the cutting apparatus 1 is in a standby condition, before starting a new cutting process on the pipe 2 made of plastic material from the above-mentioned and not illustrated extrusion station.

The second control arm 6, with the first electric actuator 7 having the relative rod 10 retracted inside the cylinder 9, keeps the first rocker arm 4 in a non-operating configuration, in which, that is, the cutting tool 5 supported by it is disengaged from the pipe 2.

Figure 2:
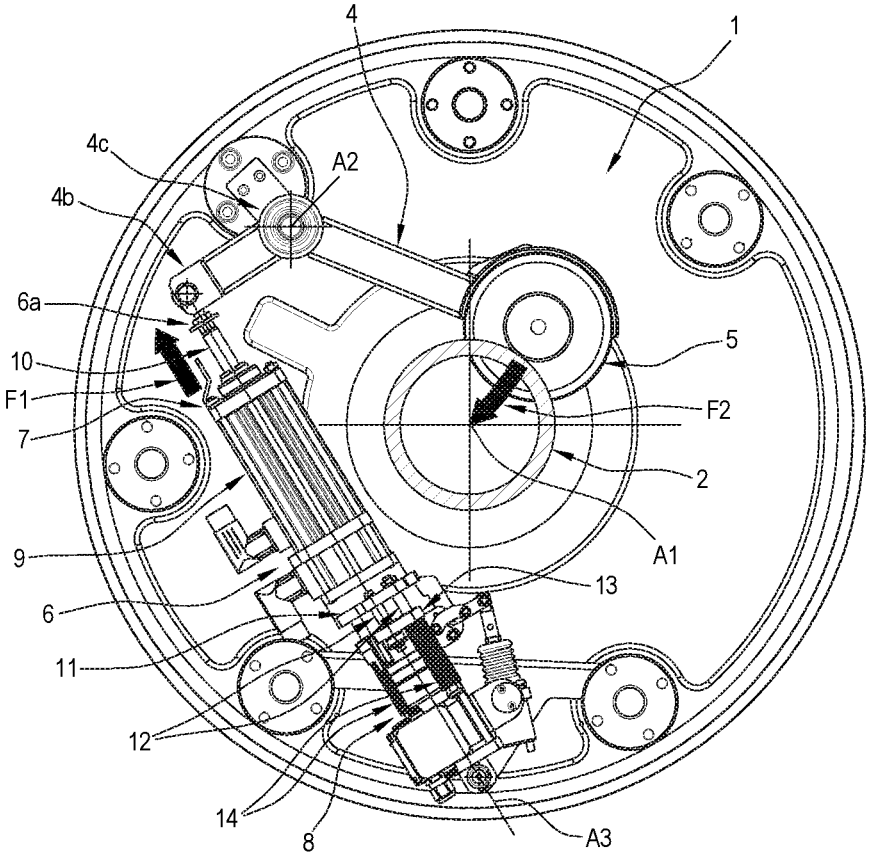

As illustrated in FIG. 2, in order to cut the pipe 2, the first actuator 7 is activated in such a way that the extension of the rod 10 causes a rotation of the first rocker arm 4 in the direction of the arrow F2, in a clockwise direction with reference to the drawing, as a result of which rotation the cutting tool 5 moves radially towards the axis A1 of the pipe 2, meeting the latter along its path.

The fact that during the cutting of the pipe 2 the rotatable structure 3 and the cutting apparatus 1 integral with it rotates about the axis A1 is not significant for the purposes of the invention and, therefore, will not be highlighted in this text.

FIG. 2 illustrates an operating configuration of the first rocker arm 4 wherein the cutting tool 5 penetrates into the wall thickness of the pipe 2.

If the cutting process is performed normally, the cutting tool 5 completely cuts the pipe 2 and the first electrical actuator 7 then reverses the motion of the rod 10 moving away the first rocker arm 4, and the respective tool 5, from the pipe 2 to re-position it in the configuration of FIG. 1 waiting to execute a new cutting process.

Figure 3:
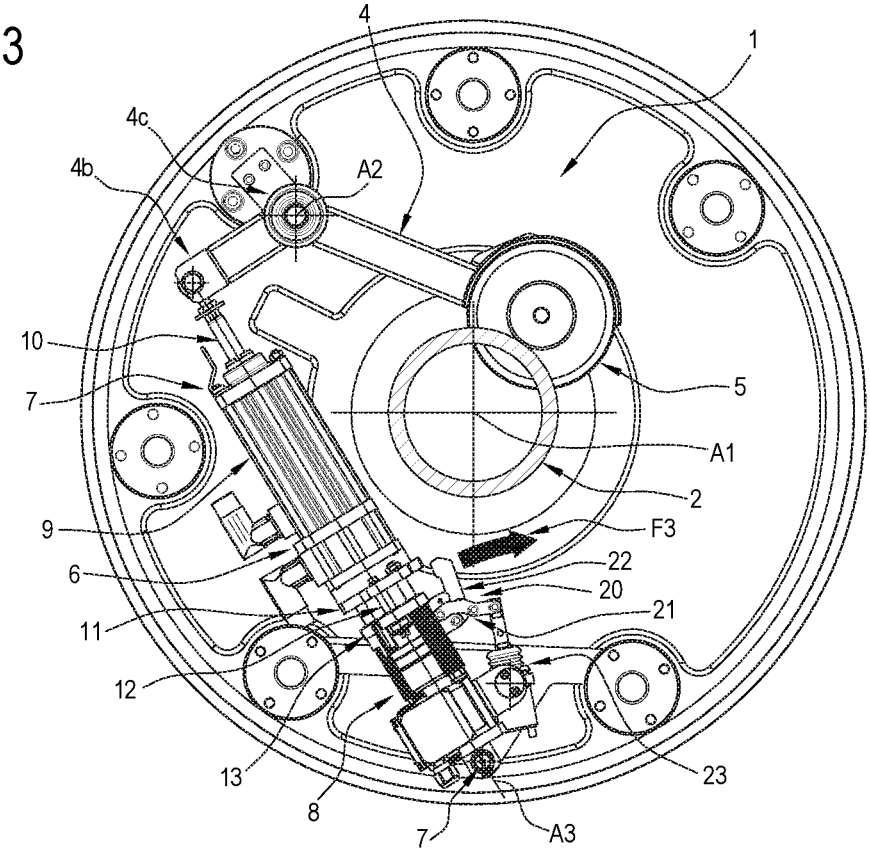

FIG. 3 shows a possible drawback which might occur during the cutting process, for example consisting of an emergency stop or an electrical power failure of any nature resulting in the stopping of the rotational motion of the structure 3 rotatable about the axis A1, with the cutting tool 5 engaged with the pipe 2. In this case, the pipe 2 continues to advance, even just by inertia, by the pushing action of the portion of pipe located upstream, coming from the extrusion station.

The inability, due to the electrical power failure, by the first electrical actuator 7 to withdraw the rod 10 and hence move the cutting tool 5 away from the pipe 2, means that the tool 5 remains in interference with the pipe 2 with the risk that the latter, with a relative forward movement, can damage the cutting apparatus 1.

This condition must be absolutely avoided.

Again with reference to FIG. 3, in a condition of substantial machine stoppage, the third actuator 23 is activated automatically, applying a pulling action on the knee-type linkage 21, such as to move the stop lever 22 in the direction of the arrow F3, in such a way as to disengage it from the first plate 11.

Advantageously, the third actuator 23 is of the electromagnetic type and is powered, during the above-mentioned emergency situations, by a respective battery of substantially known type and not illustrated or described further.

Figure 4:
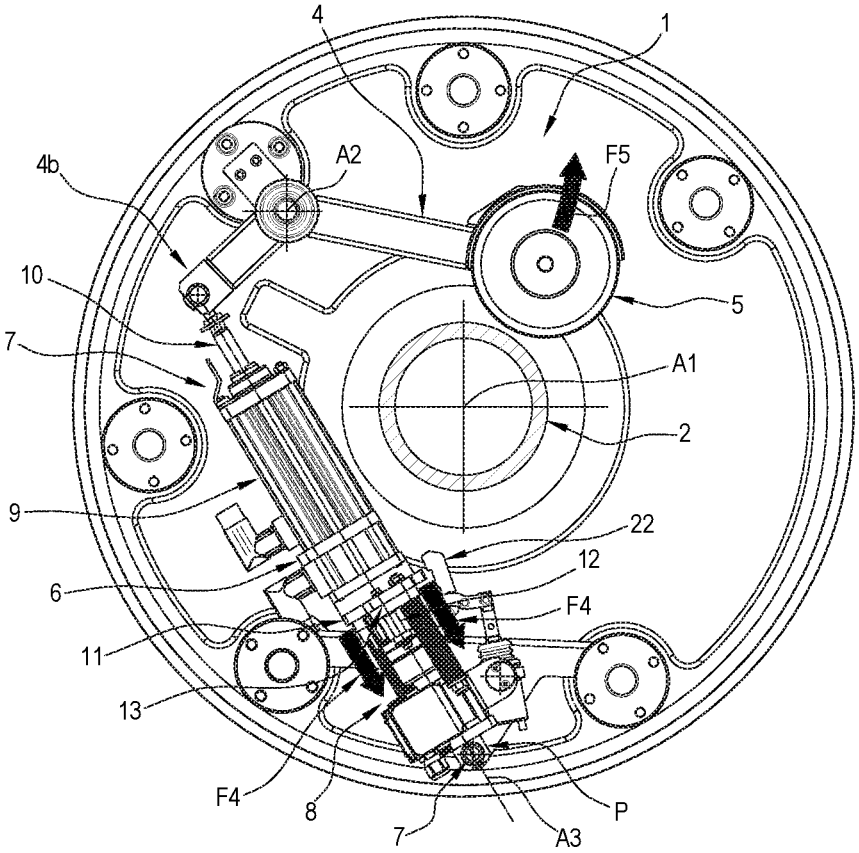

As illustrated in FIG. 4, without the obstacle created by the stop lever 22, the assembly consisting of the first electric actuator 7 and the first plate 11 move, under the action of the elastic force exerted by the helical springs 14, towards the supporting body 8, in the direction of the arrows F4.

The above-mentioned movement of the first electrical actuator 7 towards the supporting body 8 stops with the first plate 11 in contact with the second plate 13, as illustrated in FIG. 4.

Due to the fact that the supporting body 8 is pivoted stably on the rotatable structure 3 by means of the pin P, the moving towards each other, with the rod 10 stationary relative to the cylinder 9 due to the power failure, translates operatively into a movement of the first rocker arm 4, with anticlockwise rotation in the direction of the arrow F5.

The anticlockwise rotation of the first rocker arm 4 moves it to its non-operating configuration, that is to say, completely disengages the cutting tool 5 from the pipe 2.

The movement just described, obtained under emergency conditions, that is to say, in the absence of electricity supply and only thanks to the elastic energy accumulated by the helical springs 14, instantaneously returns the cutting apparatus 1 to a safe condition wherein the feeding of the pipe 2 coming from the extrusion station does not cause any damage to the apparatus 1.

Figure 5:
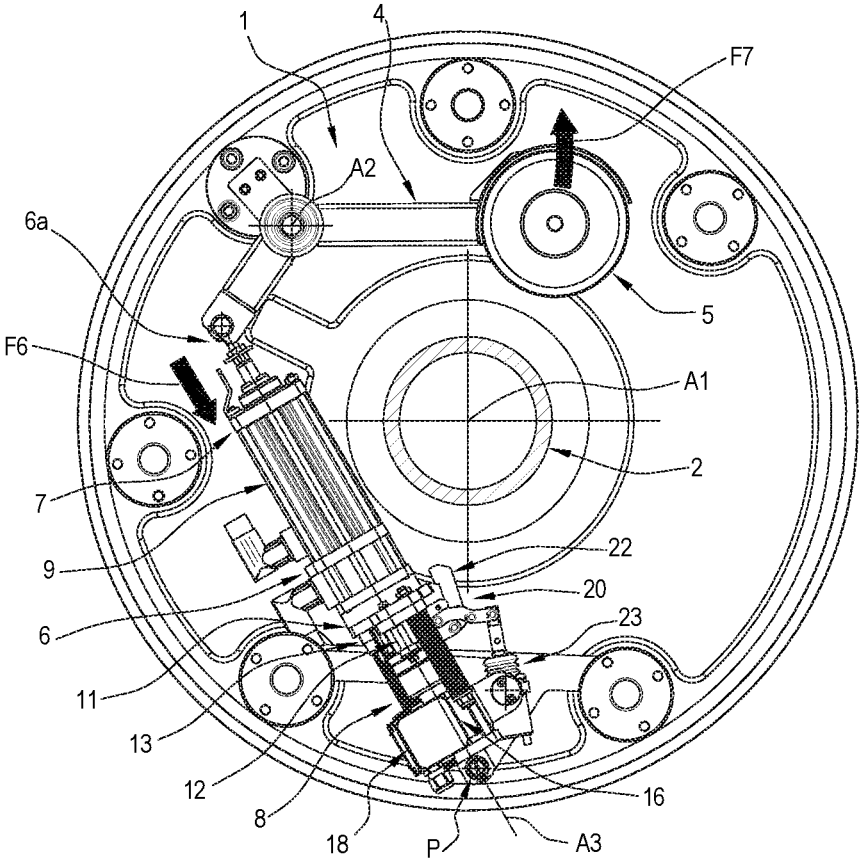

With reference to FIG. 5, once the anomaly which has caused the disengaging of the cutting tool 5 from the pipe 2 has been eliminated and the normal electricity supply has been re-established, the first electric actuator 7 is actuated to withdraw the rod 10 in the direction of the arrow F6.

This retraction of the rod 10 causes a consequent anticlockwise rotation, in the direction of the arrow F7, of the first rocker arm 4, moving the cutting tool 5 further away from the outer surface of the pipe 2.

Figure 6:
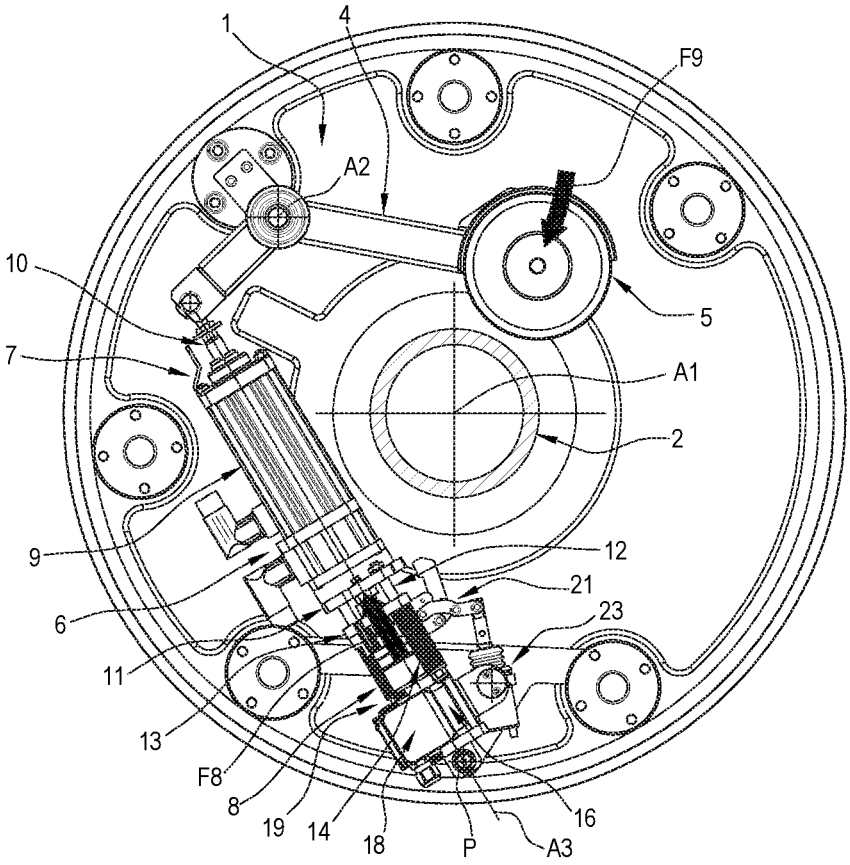

As clearly illustrated in FIG. 6, the control arm 6 should be returned to the relative normal operating condition, that is to say, also restoring the operation of the components which generated the relative safety movement between the first electric actuator 7 and the supporting body 8.

For this purpose, the actuating element 19 is activated, which, by means of the lead nut and screw mechanism 16 actuated by the second electric actuator 18, pushes the first plate 11 and the first electric actuator 7, integral with it, away from the second plate 13, in the direction of the arrow F8.

More in detail, it is the rod 17 pushing the lead nut and screw mechanism 16 which extends in the direction of the arrow F8 and pushes in that direction the first plate 11 away from the second plate 13.

During the moving away of the two, first and second, plates 11, 13 there is a new compression of the helical springs 14 fitted on the rods 12.

The compression of the helical springs 14 determines the storing of elastic energy in view of a new activation if necessary.

Again with reference to FIG. 6, the moving away of the first electric actuator 7 from the supporting body 8 which re-establishes the original longitudinal dimensions of the second control arm 6 also results in the clockwise rotation of the first arm 4 according to the direction of the arrow F9, with relative approach of the cutting tool 5 to the pipe 2, although without interfering with it, but simply repositioning the tool 5 at the ideal distance from the pipe 2 so as to wait for the start of a new process.

Lastly, as shown in FIG. 7, after reaching again the initial configuration just described above, the third electric actuator 23 controls the knee-type linkage 21 so as to again move the lever 22 to engage in contact with the first plate 11, to prevent it from being moved spontaneously towards the second plate 13.

Figure 7:
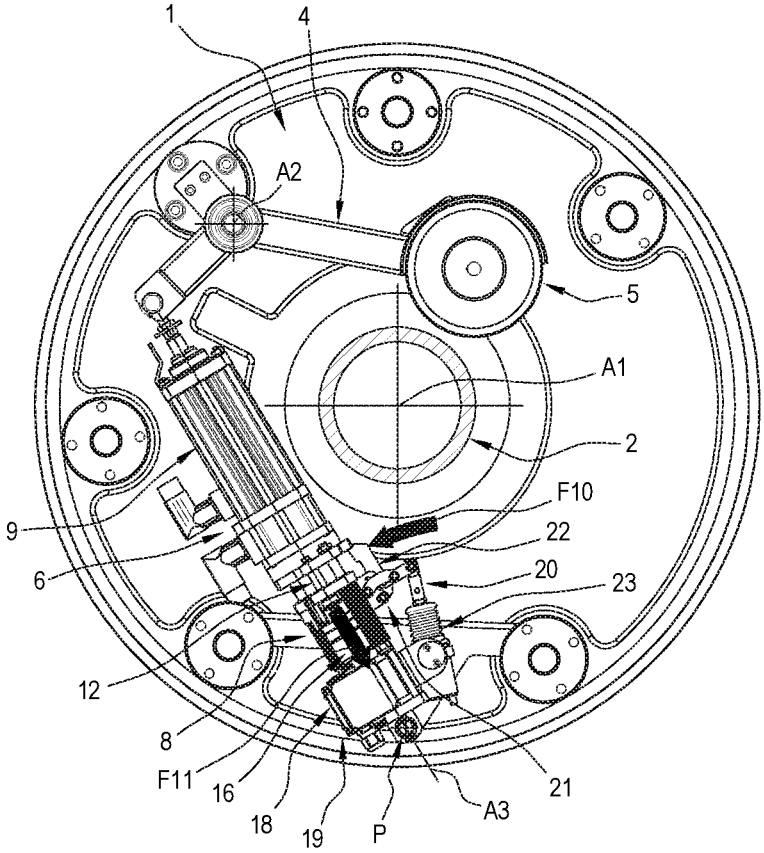

The movement performed by the stop lever 22 to return to its engaging condition with the first plate 21 is shown in FIG. 7 by the arrow F10.

After reaching the engagement configuration by the stop lever 22, the second electric actuator 18 activates the lead screw mechanism 16 in order to bring its pushing rod 17 back, visible in FIG. 10, to its initial configuration (retracted from the first plate 11 in the direction of the arrow F11), allowing (in a possible new abnormal condition) a new approach between the two, first and second, plates 11, 13.

The cutting apparatus 1 according to the invention achieves the preset aims and brings important advantages.

A first advantage connected to the invention is the fact that, instead of the hydraulic actuation of the cutting tool, known in the prior art, it has adopted an electric drive, which is more versatile and simpler in terms of both installation and maintenance.

Another advantage connected with the apparatus according to the invention is due to the possibility, in the case of a power supply fault, of disengaging in a quick and safe manner the cutting apparatus from the pipe being processed, guaranteeing maximum safety for the system.

A further advantage connected to the adoption of an electrical actuation of the cutting element is given by the possibility to optimise the approach of the tool to the pipe to be cut as a function of the diameter of the latter and generally to be able to define as required the relative motion of the cutting tool relative to the pipe.

Moreover, thanks to the adoption of servo-controlled electric actuators in the control of the first arm, it is possible to adjust with great ease the stroke of the tool also as a function of the diameter of pipe being processed, in such a way as to minimise the distance between the tool waiting to make a cut and the pipe to be cut.

It is also very simple to differentiate the radial speeds of the tool relative to the pipe between the approach step and the cutting phase in order to optimise the processing times or vary and control in a continuous fashion the penetration force of the tool or define a specific trajectory of penetration of the tool into the thickness of the pipe, as required, for example, for particular plastic materials in order to prevent undesired fragile breakages of the pipe or poor quality of the cuts performed.

Being able to control the cutting process with the usual movement systems (pneumatic or hydraulic) in such a dynamic and immediate fashion is prohibitive both in terms of excessive constructional complexity and less control precision which can be obtained.

According to alternative embodiments of the cutting apparatus according to the invention, which are not illustrated, the first arm and the second control arm adopt different configurations, also linked to a different arrangement of the pivot points.

By way of example, by making the first arm not in the form of a rocker, that is to say, not pivoted centrally, a shortening of the linear actuator may be necessary for moving the cutting tool towards the pipe instead of an extension, as shown in the accompanying drawings.

In other words, the variability of the normal position spaced or close to the second control arm lies in the construction of the linkage: with the first arm having an intermediate pivot between the cutting tool and the actuator, the normal position is spaced apart since the actuator extends in order to cut and therefore, in the case of an electrical power failure, the second control arm must be withdraw; if, on the other hand, the point of application of the force of the actuator is in an intermediate position between the cutting tool and the pivot of the first arm, then the actuator would move the cutting tool to an operating condition by withdrawing and, therefore, in the case of blockage, the second control arm should be extended.

According to further possible embodiments, the first arm is not in the form of a pivoted lever but connected directly and rigidly to the second arm, thus being able to be considered as an extension of the latter.

In that case, the movement between the non operating and operating configurations of the first arm and therefore of the tool is performed directly by the first actuator, that is to say, without any leverage interposed between the tool and the second arm.

In other words, according to these embodiments, not illustrated, the second arm and the first arm substantially define a single arm for supporting and moving the tool.

Similarly to what has been described above with regard to the possibility of different embodiments of the first arm, also for the second control arm there are alternatives to the embodiment illustrated and described. More specifically, in this perspective, the concept of slidable connection between the first electric actuator and the supporting body is to be considered in a broad sense as the possibility of reciprocal movement between the two, clearly being also understood as mutual rotation if the two parts were pivoted to each other. In effect, by way of an example, these two parts could also be connected like a compass and extend rotating between themselves to modify the mutual distance of the relative ends.

The invention claimed is:

1. An apparatus for cutting pipes made of plastic material in automatic cutter machines, comprising:

a cutting tool for cutting pipes made of plastic material, a first arm, for supporting the cutting tool, movable between a non-operating configuration at which the cutting tool is disengaged from the pipe and an operating configuration wherein the cutting tool is configured to exert a cutting action on the pipe, a second arm, for controlling the first arm, operatively connected to the first arm for moving the first arm between the non-operating and operating configurations, second arm comprising a first electric actuator and a supporting body for supporting the first electric actuator, the first electric actuator and the supporting body being connected in a mutually slidable manner for modifying a reciprocal position between a close together position and a spaced apart position, a locking element configured for stably holding the first electric actuator and the supporting body in a first reciprocal position of one of either the close together position or the spaced apart position, a disengaging device configured for releasing the locking element and allowing the first electric actuator and the supporting body to reach a second reciprocal position of the other between the close together position and the spaced apart position.

2. The apparatus according to claim 1, and further comprising an elastic device configured for pushing the first electric actuator and the supporting body upon reaching the second reciprocal position.

3. The apparatus according to claim 1, and further comprising a drive member for returning the first electric actuator and the supporting body to the first reciprocal position.

4. The apparatus according to claim 3, wherein the drive member comprises an electric lead nut and screw mechanism and a second electric actuator configured to actuate the electric lead nut and screw mechanism.

5. The apparatus according to claim 1, wherein the locking element comprises a toggle linkage.

6. The apparatus according to claim 5, wherein the disengaging device comprises a second electric actuator configured for generating a movement of the locking element a movement so as to free the mutual sliding of the first electric actuator and the supporting body.

7. The apparatus according to claim 1, wherein the disengaging device comprises a second electric actuator configured for generating a movement of the locking element a movement so as to free the mutual sliding of the first electric actuator and the supporting body.

* * * * *